US011371410B2

(12) United States Patent
Hobraiche et al.

(10) Patent No.: US 11,371,410 B2
(45) Date of Patent: Jun. 28, 2022

(54) PRESSURE COMPENSATOR IN A BUBBLE OF LIQUID ENCASED IN ICE

(71) Applicant: Plastic Omnium Advanced Innovation and Research, Brussels (BE)

(72) Inventors: Julien Hobraiche, Chevriere (FR); Nicolas Le Clec'h, Compiegne (FR); Thierry Leguay, Brussels (BE)

(73) Assignee: Plastic Omnium Advanced Innovation and Research, Brussels (BE)

( * ) Notice: Subject to any disclaimer, the term of this patent is extended or adjusted under 35 U.S.C. 154(b) by 563 days.

(21) Appl. No.: 16/473,944

(22) PCT Filed: Dec. 22, 2017

(86) PCT No.: PCT/EP2017/084532

§ 371 (c)(1),
(2) Date: Aug. 21, 2019

(87) PCT Pub. No.: WO2018/122201

PCT Pub. Date: Jul. 5, 2018

(65) Prior Publication Data

US 2019/0368405 A1 Dec. 5, 2019

(30) Foreign Application Priority Data

Dec. 26, 2016 (FR) ..... 1663385

(51) Int. Cl.
*F01N 3/20* (2006.01)
*F15B 1/24* (2006.01)

(52) U.S. Cl.
CPC ..... *F01N 3/2066* (2013.01); *F01N 2260/10* (2013.01); *F01N 2610/02* (2013.01); *F01N 2610/1406* (2013.01); *F15B 1/24* (2013.01)

(58) Field of Classification Search
CPC .... F15B 1/24; B65D 90/34; F01N 2610/1406
See application file for complete search history.

(56) References Cited

U.S. PATENT DOCUMENTS

| | | | |
|---|---|---|---|
| 5,056,493 | A | 10/1991 | Holzer |
| 2008/0135005 | A1 | 6/2008 | Kotwicki et al. |
| 2010/0236243 | A1 | 9/2010 | Lolas et al. |
| 2011/0147636 | A1 | 6/2011 | Oikawa |
| 2012/0315196 | A1 | 12/2012 | Maus et al. |

(Continued)

FOREIGN PATENT DOCUMENTS

| | | |
|---|---|---|
| CN | 2210990 Y | 10/1995 |
| CN | 2615485 Y | 5/2004 |

(Continued)

OTHER PUBLICATIONS

International Search Report dated Feb. 8, 2018 in PCT/EP2017/084532 filed on Dec. 22, 2017.

*Primary Examiner* — Ngoc T Nguyen
(74) *Attorney, Agent, or Firm* — Oblon, McClelland, Maier & Neustadt, L.L.P.

(57) ABSTRACT

A pressure compensator for regulating the pressure in a bubble of liquid entirely enclosed in a forming volume of ice, atop which is a volume of gas, and which is contained in a reservoir closed by walls. The compensator includes a plunger formed of a head atop a body. The faces of the body of the plunger have a taper which is positive or zero in an essentially vertical, top to bottom direction.

12 Claims, 2 Drawing Sheets

(56) References Cited

U.S. PATENT DOCUMENTS

| | | | | |
|---|---|---|---|---|
| 2013/0074936 | A1 | 3/2013 | Merchant et al. | |
| 2014/0117015 | A1 | 5/2014 | Kraus | |
| 2016/0177800 | A1 | 6/2016 | Leclec'h et al. | |
| 2017/0022920 | A1 | 1/2017 | Hill | |
| 2018/0051612 | A1* | 2/2018 | Filipovski | F01N 3/206 |
| 2018/0128141 | A1* | 5/2018 | Pan | F01N 3/2066 |
| 2018/0135495 | A1 | 5/2018 | Yang et al. | |
| 2019/0003364 | A1* | 1/2019 | Simpson | F01N 3/2066 |

FOREIGN PATENT DOCUMENTS

| | | | |
|---|---|---|---|
| CN | 101201172 | A | 6/2008 |
| CN | 102102612 | A | 6/2011 |
| CN | 102713184 | A | 10/2012 |
| CN | 103277176 | A | 9/2013 |
| CN | 103827457 | A | 5/2014 |
| CN | 103930659 | A | 7/2014 |
| CN | 203972430 | U | 12/2014 |
| CN | 204437388 | U | 7/2015 |
| CN | 105189965 | A | 12/2015 |
| CN | 105705740 | A | 6/2016 |
| CN | 106170683 | A | 11/2016 |
| DE | 3916574 | A1 | 11/1990 |
| DE | 10 2006 050 808 | A1 | 4/2008 |
| DE | 10 2006 061 735 | A1 | 7/2008 |
| DE | 10 2008 054 629 | A1 | 6/2010 |
| DE | 10 2009 000 107 | A1 | 7/2010 |
| DE | 10 2009 029 375 | A1 | 3/2011 |
| DE | 10 2015 204 621 | A1 | 9/2016 |
| EP | 2 829 699 | A1 | 1/2015 |
| JP | 62-163823 | A | 7/1987 |
| JP | 64-83980 | A | 3/1989 |
| JP | 2000-27627 | A | 1/2000 |
| JP | 2006-123946 | A | 5/2006 |
| KR | 10-2013-0054049 | A | 5/2013 |
| WO | WO 2013/004346 | A1 | 1/2013 |
| WO | WO 2013/072191 | A1 | 5/2013 |

* cited by examiner

PRESSURE COMPENSATOR IN A BUBBLE OF LIQUID ENCASED IN ICE

This application is a United States national stage application of International Application No. PCT/EP2017/084532, filed Dec. 22, 2017, which designates the United States, and claims priority to French Patent Application No. 1663385 filed Dec. 26, 2016, and the entire contents of each of the above applications are hereby incorporated herein by reference in entirety.

The invention relates to the field of motor vehicles, and more specifically to the reservoirs which are designed to contain a liquid which can freeze in normal conditions of use of the vehicle. These reservoirs developed generally comprise a technical module, which is partly immersed, in which there are installed the pumping means as well as the devices for measurement of level or temperature which make it possible to control the distribution of the liquid contained in the reservoir.

This is the case in particular for reservoirs which contain urea, and are commonly used to supply the system for cleansing of the exhaust gases of the vehicle. This liquid starts to freeze when the temperature drops below −11° C.

For this purpose, heating means are provided in the reservoir in order to prevent the urea from freezing.

However, these means are deactivated when the vehicle is at a standstill after a period of travelling, and, when the vehicle is parked outdoors in severe outdoor winter conditions which for example can reach temperatures of approximately −40° C., the urea contained in the reservoir begins to be transformed into ice, and can lead to freezing of all of the urea in a few tens of minutes.

In these conditions of rapid freezing, degradation of the technical module which for a long time has remained unexplained has been observed, which degradation can lead to the total destruction of the technical module or of the units which it contains.

Laboratory analyses have made it possible to detect the physical phenomena which intervene during this period.

A closed reservoir equipped with a technical module and containing a certain volume of urea was placed in a cold enclosure maintained at a temperature of approximately −40° C. The technical module was totally immersed in the volume of liquid. This volume of liquid was surmounted by a gaseous part which remained at atmospheric pressure throughout the experiment. Similarly, certain units of the technical module such as the pump or the level floats were also at atmospheric pressure.

It was found that ice began to form in the vicinity of the walls of the reservoir via which the heat exchanges occur. The increase in the volume of ice then took place, progressing towards the central region of the reservoir which was occupied by the technical module. After a certain amount of time, the surface of the liquid froze in turn.

It was then observed that a bubble of liquid was created, trapped on all sides by the frozen substance, and in which the upper part of the technical module was immersed.

More detailed observation then made it possible to show that the pressure existing inside this bubble of liquid entirely surrounded by ice could then reach very high values of approximately several tens of bars.

This phenomenon is associated with the fact that the compressibility of the liquid forming the ice is low, and that, as the formation of the ice continues, the increase in volume associated with this transition subjects the bubble of liquid to pressures which progress rapidly.

As a result, the units of the technical module which remain at atmospheric pressure are subjected to mechanical stresses which are very much higher than the resistance of the materials which constitute them, which deform until they break.

When the experiment was continued, the bubble of liquid was gradually reabsorbed until all the liquid previously contained in the reservoir was transformed into ice.

In order to solve this known problem, in publication EP2829699 a deformable cavity is subjected to a pressure, associated with an exhaust in communication with the external atmosphere. The expansion of volume associated with the formation of the ice is then compensated for by the reduction in the volume of the deformable cavity. Similar embodiments are also described in publications DE102009029375, DE102006050808, or also DE102015204621 which likewise comprise deformable elements in order to absorb the variation in the volume of ice. These devices require means suitable for retaining the compressible bubble in the immersed volume. In addition, these flexible membranes operating at a low temperature have reduced mechanical characteristics and shorter service lives.

According to publication DE102008054629, a fixed duct is provided which penetrates into the bubble of liquid, and by means of which the pressurized liquid can rise to the surface. In order to prevent the liquid from freezing inside the duct, it is then necessary to provide particular means for insulation or heating.

The objective of the reservoir comprising a pressure compensation device according to the invention is to propose an original solution making it possible to overcome the above-described problems, and to control this phenomenon of excess pressure in the bubble of liquid trapped entirely in a volume of ice being formed, surmounted by a volume of gas and contained in a reservoir closed by walls, in order to avoid the degradation of the components of the technical module immersed in the liquid contained in the reservoir.

This reservoir, closed by walls, thus comprises a pressure compensator in order to regulate the pressure in a bubble of liquid entirely trapped in a volume of ice being formed, surmounted by a volume of gas.

The pressure compensator comprises a plunger, which is mobile along a vertical axis, formed by a head surmounting a body, and the faces of the body of the plunger have a positive or zero tapering in a direction which is vertical and oriented from the top downwards, with a height of the body of the plunger being designed such that a lower part of the body remains immersed in the bubble of liquid, and, such that an upper part of the body passes through the upper layer of ice, and remains in the volume of gas, so that, when the plunger rises under the action of the pressure which exists in the bubble of liquid and is exerted on the part of the body of the plunger remaining immersed in the liquid, an additional volume is created within the space occupied by the bubble of liquid, and contributes towards reducing the pressure in this space.

When the compensator is placed in the reservoir, so that the body of the plunger is disposed substantially above the technical module, and plunges into the bubble of liquid surrounding said module, raising of the plunger under the effect of the pressure existing in the bubble of liquid will make it possible to clear an additional volume within the space occupied by the bubble, and contribute towards reduction of the pressure in this space.

In addition, by selecting the tapering angle carefully, a space is created when the plunger is raised, between the plunger and the ice which was trapping it, thus allowing the liquid contained in the bubble to escape in the direction of the frozen surface forming the interface between the block of ice and the volume of gas, which is generally at atmospheric pressure. The pressure in the bubble of liquid drops again, and the body of the plunger redescends in order to return into contact with the ice. These small alternating movements are continued until all of the bubble of liquid is transformed into ice.

The combination of the two mechanisms described above makes it possible to reduce the negative effects of the excess pressure on the units of the technical module, and protects the units against any deterioration liable to put these devices out of use.

The explanations used to support the present description relate to a reservoir containing urea, but it will be appreciated that the reservoir can contain any type of liquid going into a solid phase in temperature conditions which are liable to be observed during the common use of said reservoir. A reservoir containing water, or water mixed with an alcohol, such as a reservoir containing the windscreen wiper liquid, can advantageously comprise a pressure compensator as described above, in order to prevent the degradation of the units contained in the technical module fitted in said reservoir.

The reservoir equipped with a pressure compensator according to the invention can also comprise the following characteristics, in isolation or in combination:

- the tapering angle of the body of the plunger is between 2° and 15°, so that, when the plunger rises, a space is formed between the ice and the surface of the body of the plunger, and allows the liquid contained in the bubble to escape;
- the body of the plunger has a substantially frusto-conical form;
- the body of the plunger is substantially non-compressible;
- the body of the plunger is made of polyoxymethylene;
- the head of the plunger circulates in the vertical direction, between a high limit and a low limit, in a hollow cylinder which is secured on an upper wall of the reservoir;
- the hollow cylinder comprises a vent;
- a device exerts a predetermined constant force directed from the top downwards on the head of the plunger;
- the device which exerts a predetermined constant force directed from the top downwards on the head of the plunger is formed by a spring which is disposed in the hollow cylinder, and is interposed between the head of the plunger and the upper wall of the reservoir;
- the head and the body of the plunger form a hollow body which is closed in the upper part by a hydrophobic membrane;
- the head and the body of the plunger form a hollow body filled with a closed-cell foam;
- an immersed technical module, installed vertically below the pressure compensator.

The invention will be better understood by reading the appended figures, which are provided by way of example, and do not have any limiting nature, wherein.

Figure 1:
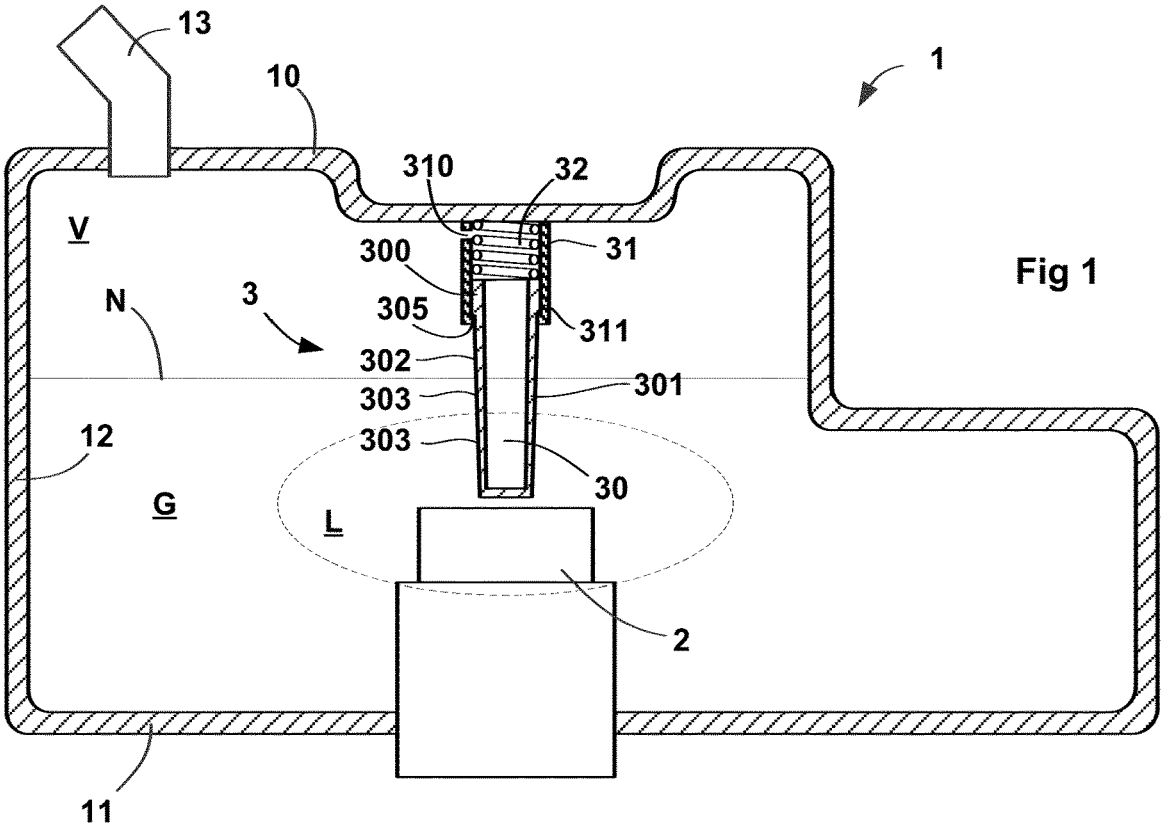
FIG. 1 represents a view in cross-section of a reservoir in which a pressure compensator according to the invention is implanted.

FIG. 1 represents schematically a reservoir 1 closed by an upper wall 10, a lower wall 11 and lateral walls 12. A filling tube 13 makes it possible to fill the reservoir.

A technical module 2 is implanted on the wall 11 forming the base of the reservoir 1. This technical module passes through the base of the reservoir in order to make it possible to connect the units contained in the module to an electrical supply source, to the control and command modules, or also to the ducts for output of the liquid going to the exhaust gas cleansing system which are placed at atmospheric pressure on the exterior of the reservoir. The other, secondary units such as the vents and heating means are not represented.

The reservoir contains a liquid which is in the process of freezing, and comprises a volume in a solid phase G and a volume which is still in liquid form L, and forms a liquid bubble, which is delimited by the broken line, and is entirely trapped in the volume of ice G.

The level N symbolizes the line of separation between the upper part of the reservoir filled with gas V and the block of ice G. This level N corresponds substantially to the level of the liquid contained in the reservoir before the liquid begins to freeze. The gaseous part V of the reservoir is at atmospheric pressure, and the gas which is contained in this part is formed by a mixture of liquid in a vapor phase and air.

The pressure compensator 3 is disposed vertically above the technical module 2, such as to protect the module against the detrimental effects which a bubble of liquid L forming in this area could cause. It will be noted here that the bubble of liquid L can spread into other areas of the reservoir in which the effects of the excess pressure remain without consequence.

Figure 2:
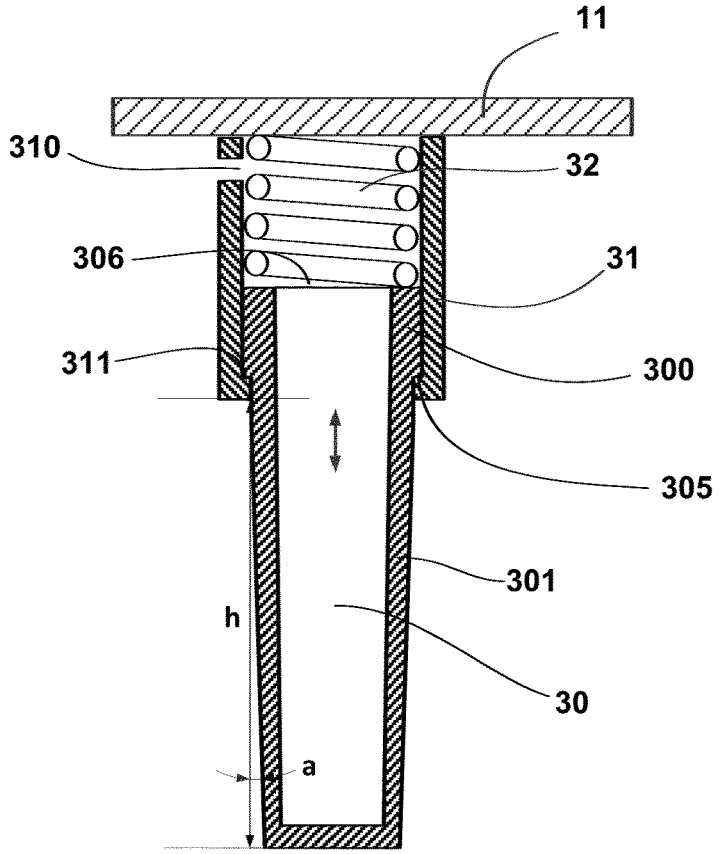
FIG. 2 is a view of a detail of the compensator in FIG. 1.

The pressure compensator comprises a plunger 30 formed by a head 300 surmounting a body 301. The body of the plunger 301 shown in detail in FIG. 2 in this case has the form of a truncated cone with a vertical axis.

This frusto-conical form is particularly well suited for the surface of the body 301 of the plunger 30 to have positive tapering with a vertical axis in a direction going from the top downwards. In other words, this means that the body 301 of the plunger 30 can be extracted towards the top of the ice which surrounds it, without being prevented by a particular relief forming a counter-taper. This requirement means that no surface of the body of the plunger, or in other words no plane tangent to the surface of the body of the plunger, should be strictly parallel or form a negative angle to the vertical. Thus, the body of the plunger can have forms as varied for example as the form of an inverted pyramid which is truncated at its top.

In the case in question the frusto-conical form forms a constant positive tapering angle a with the vertical direction. This angle could be equal to zero, but it will then be observed that the radial stresses exerted by the ice on the surface of the body of the plunger, and the friction forces which are exerted between the wall of the body of the plunger and the ice, can prevent the plunger from rising. Therefore it will be preferable to select a tapering angle which is at least equal to 2°.

It will be noted here that the larger the tapering angle, the more the space created between the ice and the body of the plunger increases, and the more the liquid which is present in the bubble can escape easily. An angle of between 2° and 15° seems to be able to satisfy all the conditions of use. A tapering angle which is too large would have the effect of increasing the size of the compensator unnecessarily, and a tapering angle which is too small does not make it possible to clear a space to allow the liquid to escape.

It will be appreciated that, in order for the pressure force generated on the body 301 of the plunger to give rise to raising of said plunger, the body 301 of the plunger is designed to be substantially non-compressible. The term "substantially" means the fact that any variation of volume associated with the pressure exerted on the body of the plunger is not of a nature such as to modify the resultant of the forces allowing the plunger to rise.

The body of the plunger can be formed by a metal which is suitable for being able to be immersed in the solution contained in the reservoir.

However, in order to reduce the friction forces between the ice and the plunger, as well as the erosion of the surface of the plunger 30, the plunger 30 can advantageously be made of material such as a polyoxymethylene. Thanks to its structure and a high level of crystallinity, this material provides very good physical characteristics, i.e. a low coefficient of friction and very good resistance to abrasion, a high level of resistance to traction and impacts, very good resistance to chemical agents, excellent dimensional stability, good resistance to creep, and finally an extensive usage temperature range.

Figure 3:
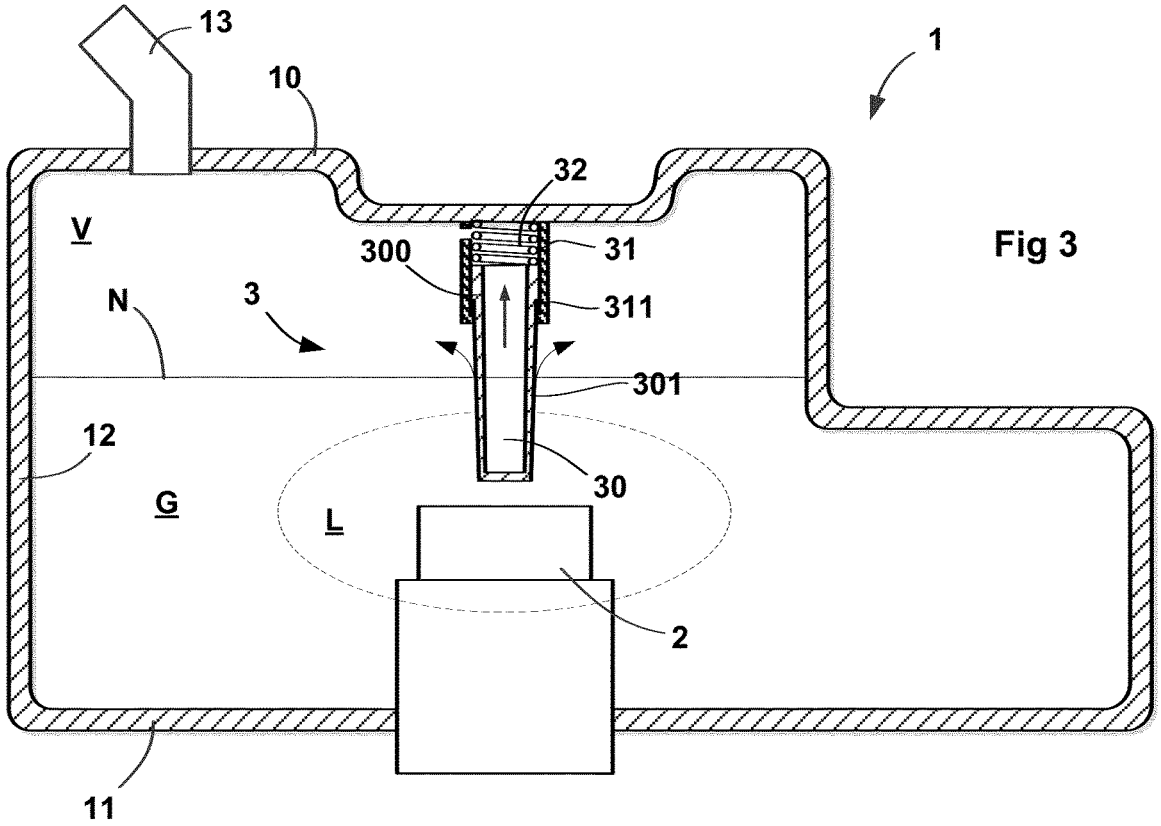
FIG. 3 illustrates the situation in which the compensator is raised, and allows part of the liquid contained in the bubble of liquid to escape.

FIG. 3 makes it possible to visualize the movement during which the plunger 30 rises, and clears a space between the ice G and the surface of the plunger, thus allowing the liquid L contained in the bubble to escape.

The height h of the body 301 of the plunger 30 is designed such that, when the pocket of liquid L appears during the freezing process, the lower part 303 of the body 301 is immersed in the liquid, the intermediate part 303 of the body being trapped in the volume of ice G surmounting the bubble of liquid, and the upper part 302 of the body of the plunger remaining in the air-filled part V of the reservoir.

This adaptation can be carried out by calculation by applying the laws of thermodynamics and of heat exchanges between the walls of the reservoir and the liquid, or more simply by experimental observation of the development of the freezing of the liquid contained in the reservoir. In practice, this amounts to positioning the low part of the plunger 30 as close as possible to the center of the bubble of liquid, the location of which is established by means of an experimental process.

The body 301 of the plunger 30 is surmounted by a head 300.

This head 300 slides in a substantially vertical direction in a hollow cylinder 31, the upper part of which is rendered integral with the upper wall 10 of the reservoir 1. In this case, substantially vertical means a direction which forms an angle of +/−15° and preferably +/−10° with the vertical direction.

Advantageously, the hollow cylinder is formed by a thermoplastic material which is compatible with the material forming the walls of the reservoir onto which it is welded. In practice, this hollow cylinder can advantageously be made of high-density polyethylene (HDPE).

A vent 310 is positioned in the upper part of the hollow cylinder 31.

The course of the head 300 of the plunger is blocked downwards by a collar 311 which interacts with a shoulder 305 disposed on the head of the plunger 30. Similarly, the course of the plunger is limited upwards by the wall 11 of the reservoir, or by a high mechanical stop which is similar to the low stop described above, or by the contiguous turns of the spring.

A spring 32 is interposed between the top of the head 300 and the wall 11. This spring exerts a constant force which is directed from the top downwards on the head 300 of the plunger 30.

By adapting the calibration of the spring carefully, it is thus possible to control the pressure threshold which exists in the bubble of liquid L, from which the plunger 30 will rise. Above this threshold, the plunger 30 rises, and releases the pressure in the bubble of liquid L, and below this threshold the plunger 30 returns and is supported on the shoulder 305, or, in the case when the space in which the liquid circulates itself freezes, on the ice itself.

It will be noted here that the spring can be replaced by any type of equivalent means which makes it possible to raise or lower the plunger in a controlled manner. By way of example, and although it has the disadvantage of increasing the on-board mass, a ballasted plunger could also be suitable.

The walls of the head 300 and the body 301 of the plunger 30 delimit an inner volume into which it must be ensured that the liquid contained in the reservoir does not penetrate. For this purpose, it is advantageously possible to cover the upper part of the head of the plunger with a hydrophobic membrane 306 which does not allow the liquid to pass, or to fill this volume with a closed-cell foam.

Figure 4:
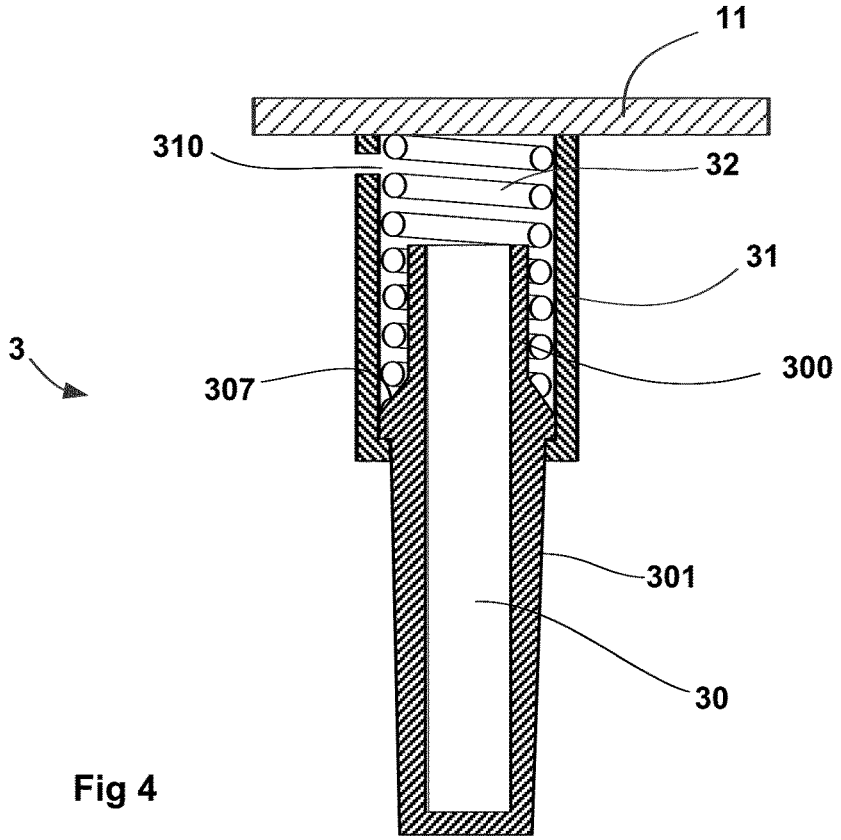
FIG. 4 illustrates an alternative embodiment of the pressure compensator.

FIG. 4 illustrates a variant embodiment of the invention, in which the head 300 of the plunger 30 comprises a reduction 307 forming an inclined support on which the spring 32 is supported. This reduction makes it possible to facilitate the flow of the liquid downwards in the undesirable event of the liquid being introduced via the vent 310.

LIST OF PARTS

1 Reservoir.
10 Upper wall of the reservoir.
11 Lower wall of the reservoir.
12 Lateral wall of the reservoir.
13 Filling tube.
2 Technical module.
3 Pressure compensator.
30 Plunger.
300 Head of the plunger.
301 Body of the plunger.
302 Air-filled upper part of the body of the plunger.
303 Intermediate part of the body of the plunger passing through the upper layer of ice.
304 Lower part of the body of the plunger immersed in the bubble of liquid.
305 Shoulder.
306 Hydrophobic membrane.
307 Reduction.
31 Hollow cylinder.
310 Vent.
311 Collar.
32 Spring.
a Tapering angle.
h Height of the body of the plunger.
G Liquid transformed into ice.
L Bubble of liquid enclosed in the ice.
V Air-filled part surmounting the ice.
N Level of the surface of ice forming the interface between the volume of the liquid in a solid phase G and the air-filled part N.

The invention claimed is:

1. A reservoir closed by walls comprising:

a pressure compensator in order to regulate the pressure in a bubble of liquid entirely trapped in a volume of ice being formed, surmounted by a volume of gas;

wherein the pressure compensator comprises a plunger, which is mobile along a vertical axis, formed by a head surmounting a body, wherein the faces of the body of the plunger have positive or zero tapering in a direction which is vertical and oriented from the top downwards, with a height of the body of the plunger being designed such that a lower part of the body remains immersed in the bubble of liquid, and wherein an upper part of the body passes through the upper layer of ice, and remains in the volume of gas, so that, when the plunger rises under the action of the pressure which exists in the bubble of liquid and is exerted on the part of the body of the plunger remaining immersed in the liquid, an additional volume is created within the space occupied by the bubble of liquid, and contributes towards reducing the pressure in this space.

2. The reservoir as claimed in claim 1, wherein the tapering angle of the body of the plunger is between 2° and 15°, so that, when the plunger rises, a space is formed between the ice and the surface of the body of the plunger, and allows the liquid L contained in the bubble to escape.

3. The reservoir as claimed in claim 1, wherein the body of the plunger has a substantially frusto-conical form.

4. The reservoir as claimed in claim 1, wherein the body of the plunger is substantially non-compressible.

5. The reservoir as claimed claim 1, wherein the body of the plunger is made of polyoxymethylene.

6. The reservoir as claimed in claim 1, wherein the head of the plunger circulates in the vertical direction, between a high limit and a low limit, in a hollow cylinder which is secured on an upper wall of the reservoir.

7. The reservoir as claimed in claim 6, wherein the hollow cylinder comprises a vent.

8. The reservoir as claimed in claim 6, wherein a device exerts a predetermined constant force directed from the top downwards on the head of the plunger.

9. The reservoir as claimed in claim 8, wherein the device which exerts a predetermined constant force directed from the top downwards on the head of the plunger is formed by a spring which is disposed in the hollow cylinder, and is interposed between the head of the plunger and the upper wall of the reservoir.

10. The reservoir as claimed in claim 1, wherein the head and the body of the plunger form a hollow body which is closed in the upper part by a hydrophobic membrane.

11. The reservoir as claimed in claim 1, wherein the head and the body of the plunger form a hollow body filled with a closed-cell foam.

12. The reservoir as claimed in claim 1, further comprising an immersed technical module, installed vertically below the pressure compensator.

* * * * *